US007057127B1

(12) United States Patent
Kuan

(10) Patent No.: US 7,057,127 B1
(45) Date of Patent: Jun. 6, 2006

(54) SAFETY ELECTRIC SWITCH

(76) Inventor: Kuo-Lung Kuan, No. 3-31, Changsheng Lane, Jenmei Li, Peitun Dist., Taichung (TW)

( * ) Notice: Subject to any disclaimer, the term of this patent is extended or adjusted under 35 U.S.C. 154(b) by 0 days.

(21) Appl. No.: 11/237,929

(22) Filed: Sep. 29, 2005

(51) Int. Cl.
*H01H 13/00* (2006.01)

(52) U.S. Cl. ..... 200/334; 200/341; 200/316; 200/43.18

(58) Field of Classification Search ..... 200/334, 200/341, 520, 310, 313, 316, 43.01, 43.11, 200/43.18
See application file for complete search history.

(56) References Cited

U.S. PATENT DOCUMENTS 5,679,936 A * 10/1997 Schaeffer et al. ..... 200/17 R
6,660,949 B1 * 12/2003 Kamino et al. ..... 200/43.07
6,660,952 B1 * 12/2003 Hsu ..... 200/334
6,861,597 B1 * 3/2005 Baechle ..... 200/43.04

* cited by examiner

*Primary Examiner*—Richard K. Lee
(74) *Attorney, Agent, or Firm*—Rosenberg, Klein & Lee

(57) ABSTRACT

A safety electric switch in which a safety plate is insertable through a button into an actuating member to lock the actuating member to the button for enabling the actuating member to be moved with the button to switch on/off the electric circuit.

1 Claim, 2 Drawing Sheets

SAFETY ELECTRIC SWITCH

BACKGROUND OF THE INVENTION

1. Field of the Invention

The present invention relates to electric switches and more particularly, to a safety electric switch.

2. Description of the Related Art

Conventionally electric power switches are operable between a first position to switch on the electric circuit and a second position to switch off the electric circuit. These electric power switches are not safe in use. During the maintenance work of an electric power switch after the circuit has been switched off, other people may switch on the electric power, thereby causing an accident.

SUMMARY OF THE INVENTION

The present invention has been accomplished under the circumstances in view. It is therefore the main object of the present invention to provide a safety power switch, which prevents triggering of the electric circuit accidentally when switched off the electric circuit during a maintenance work. According to one aspect of the present invention, a safety plate is provided and insertable through a button into an actuating member to lock the actuating member to the button for enabling the actuating member to be moved with the button to switch on/off the electric circuit. When removed the safety plate from the safety electric switch, the actuating member is unlocked from the button. When pressing the button at this time, the actuating member does no work, and the safety electric switch is constantly kept on the original "ON" or "OFF" mode. Further, a lamp bulb is installed in the actuating member to produce a visual indication signal when the safety electric switch is switched on.

DETAILED DESCRIPTION OF THE PREFERRED EMBODIMENT

Figure 1:
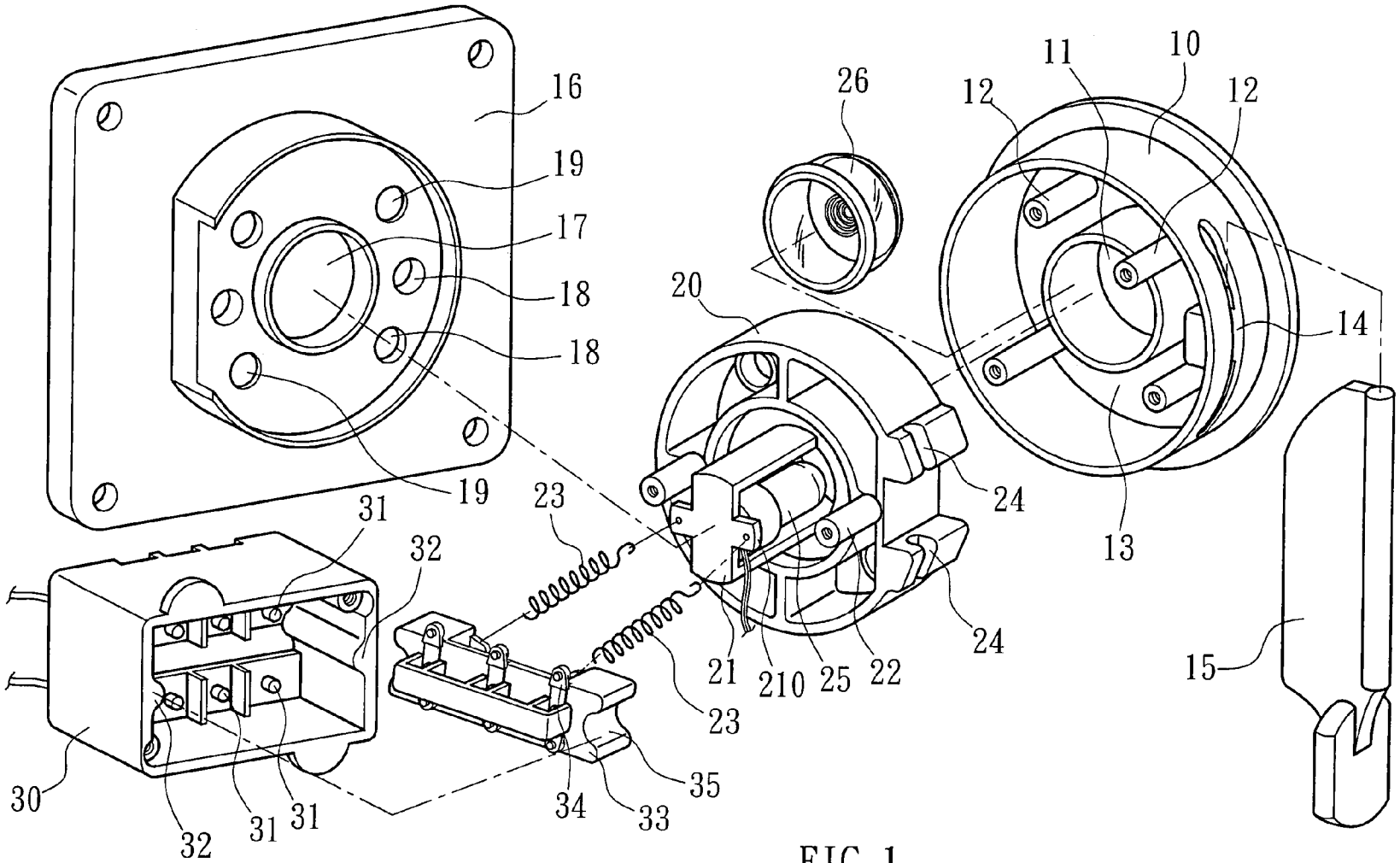
FIG. 1 is an exploded view of a safety electric switch according to the present invention.
Figure 2:
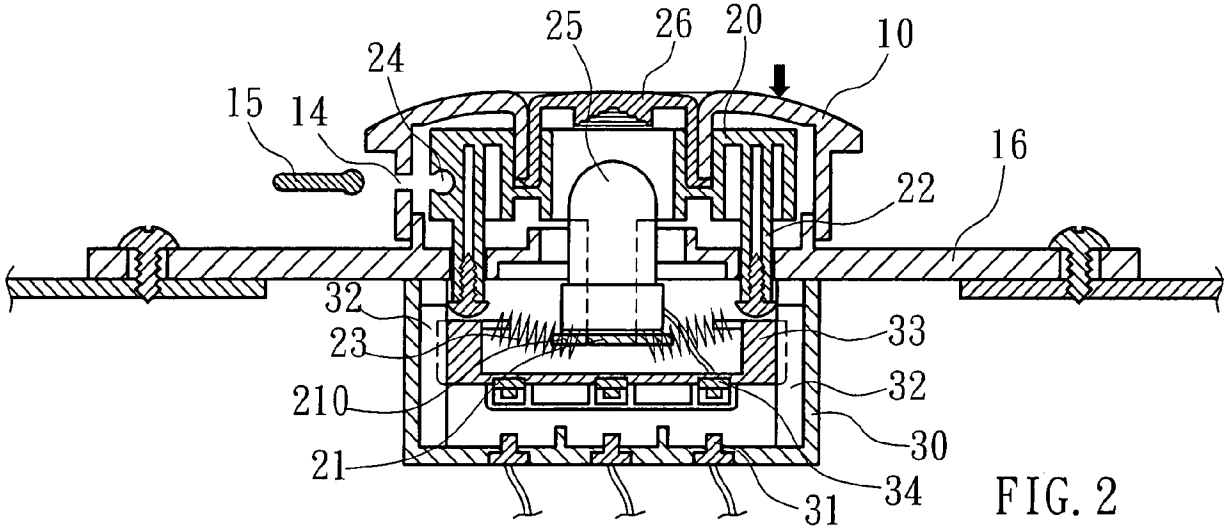
FIG. 2 is a schematic sectional view of the present invention, showing the safety plate removed from the actuating member and the button.
Figure 3:
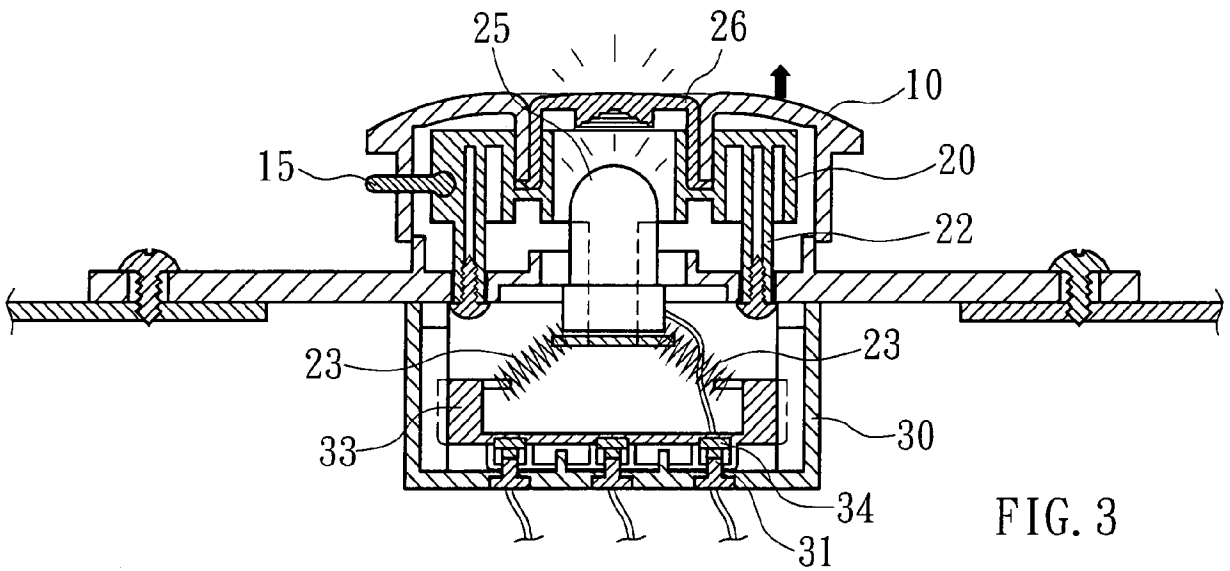
FIG. 3 is a schematic sectional view of the present invention, showing the safety plate fastened to the button and the actuating member.

Referring to FIGS. 1~3, a safety electric switch in accordance with the present invention is shown comprised of a button 10, an actuating member 20, a panel 16, a movable contact holder 33, a casing 30, two spring members 23, and a safety plate 15.

The panel 16 has a center opening 17, a plurality of first through holes 18, and a plurality of second through holes 19.

The button 10 has a center through hole 11, an annular bottom open chamber 13, a plurality of bottom coupling rods 12 suspending in the annular bottom open chamber 13 and respectively slidably coupled to the second through holes 19 of the panel 16, and a peripheral slot 14.

The actuating member 20 is mounted in the annular bottom open chamber 13 of the button 10, having a holder base 21 inserted through the center opening 17 of the panel 10, a lamp bulb 25 mounted in the holder base 21 and aimed at the center through hole 11 of the button 10, a lampshade 26 covering the lamp bulb 25, a plurality of bottom coupling rods 22 respectively coupled to the first through holes 18, and two locating grooves 24 disposed at the periphery.

The casing 30 has a plurality of metal terminals 31 mounted on the inside and electrically connected to power supply, and two guide rails 32 bilaterally disposed on the inside.

The movable contact holder 33 has a plurality of metal contact plates 34 disposed at the bottom side, and two guide grooves 35 disposed at the two distal ends thereof and respectively coupled to the guide rails 32 inside the casing 30 to guide movement of the movable contact holder 33 along the guide rails 32.

The spring members 23 are connected between respective lugs 210 at the holder base 21 of the actuating member 20 and the movable contact holder 33.

The safety plate 15 is inserted through the peripheral slot 14 and positioned in the locating grooves 24 at the periphery of the actuating member 20.

After insertion of the safety plate 15 through the peripheral slot 14 into the locating grooves 24 at the periphery of the actuating member 20 (see FIG. 3), the actuating member 20 is locked to the button 10 for synchronous movement with the button 10. When pressed the button 10 at this time, the actuating member 20 is lowered with the button 10 to bias the spring members 23 in one direction, thereby causing the metal contact holder 33 to move upwards along the guide rails 32 away from the metal terminals 31 in the casing 30, and therefore the safety electric switch is switched off. On the contrary, when pulled the button 10 upwards, the actuating member 20 is moved with the button 10 to bias the spring members 23 in the other direction, thereby causing the metal contact holder 33 to move downwards along the guide rails 32 and to force the respective metal contact plates 34 into contact with the respective metal terminals 31, and therefore the electric safety switch is switched on.

When removed the safety plate 15 from the safety electric switch after the safety electric switch has been switched off, the actuating member 20 is unlocked from the button 10 (see FIG. 2). At this time, pressing the button 10 does not move the actuating member 20, and the safety electric switch is constantly maintained in "Off" status. On the contrary, when removed the safety plate 15 from the safety electric switch after the safety electric switch has been switched on, the actuating member 20 is unlocked from the button 10 (see FIG. 2). At this time, pressing the button 10 does not move the actuating member 20, and the safety electric switch is constantly maintained in "ON" status.

Further, when the safety electric switch is switched on, the lamp bulb 25 is turned on to emit light. On the contrary, when the safety electric switch is switched off, the lamp bulb 25 is off too.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A safety electric switch comprising a casing, said casing comprising a plurality of metal terminals electrically connected to power supply, and two vertical guide rails symmetrically disposed at two sides;

a panel covering said casing, said panel having a center opening, and a plurality of first coupling holes, and a plurality of second coupling holes;

a metal contact holder mounted inside said casing and movable along said vertical guide rails, said metal contact holder comprising two guide grooves respectively coupled to said vertical guide rails to guide movement of said metal contact holder along said vertical guide rails, and a plurality of metal contact plates for contacting said metal terminals to switch on the electric circuit of the safety electric switch;

a button for moving said metal contact holder between a first position where said metal contact plates of said metal contact holder are respectively disengaged from said metal terminals, and a second position where said metal contact plates of said metal contact holder are kept in contact with said metal terminals, said button having a center through hole, an annular bottom open chamber, a plurality of bottom coupling rods suspending in the annular bottom open chamber and respectively slidably coupled to said second through holes of said panel, and a peripheral slot;

an actuating member mounted in the annular bottom open chamber of said button for moving with said button to move said meal contact holder between said first position and said second position, said actuating member having a holder base inserted through the center opening of said panel, a lamp bulb mounted in said holder base and aimed at the center through hole of said button, a lampshade covering said lamp bulb, a plurality of actuating rods coupled to said first through holes of said panel to guide movement of said actuating member relative to said panel, and at least one locating grooves disposed at the periphery;

two spring members connected between said holder base of said actuating member and said movable contact holder; and a safety plate insertable through the peripheral slot of said button into the at least one locating groove of said actuating member to lock said actuating member to said button for enabling said actuating member to be moved with said button to switch on/off the safety electric switch.

* * * * *